US005197294A

United States Patent [19]

Galvan et al.

[11] Patent Number: 5,197,294

[45] Date of Patent: Mar. 30, 1993

[54] MINIATURIZED THERMOELECTRIC APPARATUS FOR AIR CONDITIONING A PROTECTIVE BODY SUIT

[75] Inventors: Dino Galvan, Rome; Gianfranco Marcoaldi, Bracciano; Pierluigi Gemmiti, Rome; Paolo Amadesi, Bologna, all of Italy

[73] Assignees: Comitato Nazionale Per La Ricerca E Per Lo Sviluppo Dell'Energia Nucleare E Delle Energie Alternative, Rome RM; Grenfil S.r.L., Imola BO, both of Italy

[21] Appl. No.: 578,824

[22] Filed: Sep. 7, 1990

[30] Foreign Application Priority Data

Sep. 8, 1989 [IT] Italy ..... 48349 A89

[51] Int. Cl.[5] ..... F25B 21/02

[52] U.S. Cl. ..... 62/3.62; 62/3.6; 62/3.5; 62/259.3; 128/400

[58] Field of Search ..... 62/3.5, 3.6, 3.2, 259.3; 2/81, 2.1 A, 84, 94, DIG. 3; 128/400, 402

[56] References Cited

U.S. PATENT DOCUMENTS 3,040,538 4/1962 Alsing ..... 62/3.2
3,085,405 4/1963 Frantti ..... 62/3.5

FOREIGN PATENT DOCUMENTS 0799972 1/1981 U.S.S.R. ..... 62/259.3

*Primary Examiner*—John Sollecito
*Attorney, Agent, or Firm*—Browdy and Neimark

[57] ABSTRACT

A miniaturized apparatus for air conditioning comprising an assembly made up of a Peltier effect thermoelectric device, in the form of bimetallic or plurimetallic plates connected to a low voltage D.C. power supply, the opposed cold and hot surface of which are in contact with respective heat exchangers, said assembly being contained in a housing in which two distinct and separate conduits are provided for the forced flow of air through the respective ones of said heat exchangers.

9 Claims, 2 Drawing Sheets

MINIATURIZED THERMOELECTRIC APPARATUS FOR AIR CONDITIONING A PROTECTIVE BODY SUIT

BACKGROUND OF THE INVENTION

1. Field of the Invention

The present invention relates to an apparatus which, due to its characteristics, said characteristics being the reduced dimensions and the impossibility of overheating, is able to perform the programmed air conditioning of small fixed or mobile environments in a totally self-contained manner.

Said apparatus is based on the appropriate exploitation of the Peltier effect which can be seen in certain bi- or plurimetallic alloys, in which the application of a voltage difference creates displacement of the free electrons and valence electrons from lower energy bands to upper energy bands, with the pumping of energy, in the form of heat, from a high temperature electrode to one of low temperature.

2. Description of the Prior Art

The cooling and air conditioning apparatus presently known are of a macroscopic type and have dimensions such as not to allow their direct application to self-contained mini-systems; furthermore said devices contain notable quantities of closed circuit cooling fluids, which also limit their use due to toxicity. In effect the limiting fact of containing said fluids entails a series of problems both during construction and during use; furthermore, said limits impose dimensions which cannot be reduced below certain limits, and therefore a limited applicability in specific operational problems. Said apparatuses operate essentially in fixed structures of considerable size requiring a power supply of adequate dimensions and characteristics; as regards the semi-fixed devices known, it is noted that, these being also conceived in a traditional manner, they have the same limitations in terms of parts, size and power supply.

Returning to the Peltier effect mentioned above, which is the basis of the present invention, and to the metallic alloys above, it is opportune to underline that these alloys, in a paracircuital form, are available with short distances between the electrodes and with small dimensions and are arranged in small blocks, series/parallel, between two electrically insulating ceramic plates, in such a way that the heat energy is pumped from the low temperature plate to the high temperature one, thus providing a cooling effect. As the plates are made of ceramic, they present a low thermal conductivity, for which reason they are generally extremely thin and covered on the outside by a thin layer of material having a high thermal conductivity, such as aluminium, for example.

Peltier plates of different kinds, with different power supplies and performances have been available on the market for some time, but their application in the field of cooling has always been limited to low-rate heat transfers and the devices using them are of small volume and lightly refrigerated for leasure use or light pharmaceutical use.

SUMMARY OF THE INVENTION

The object of the present invention is to provide an apparatus based on the exploitation of the Peltier effect, said apparatus having an extremely reduced structure, simple and functional, such as to provide a surprising air-conditioning performance.

BRIEF DESCRIPTION OF THE DRAWINGS

The present invention will be better described below by the description of a preferred embodiment thereof, along with a particularly suitable form of application, given as a non-limiting example, with reference to the attached drawings, in which.

DESCRIPTION OF A PREFERRED EMBODIMENT

Figure 1:
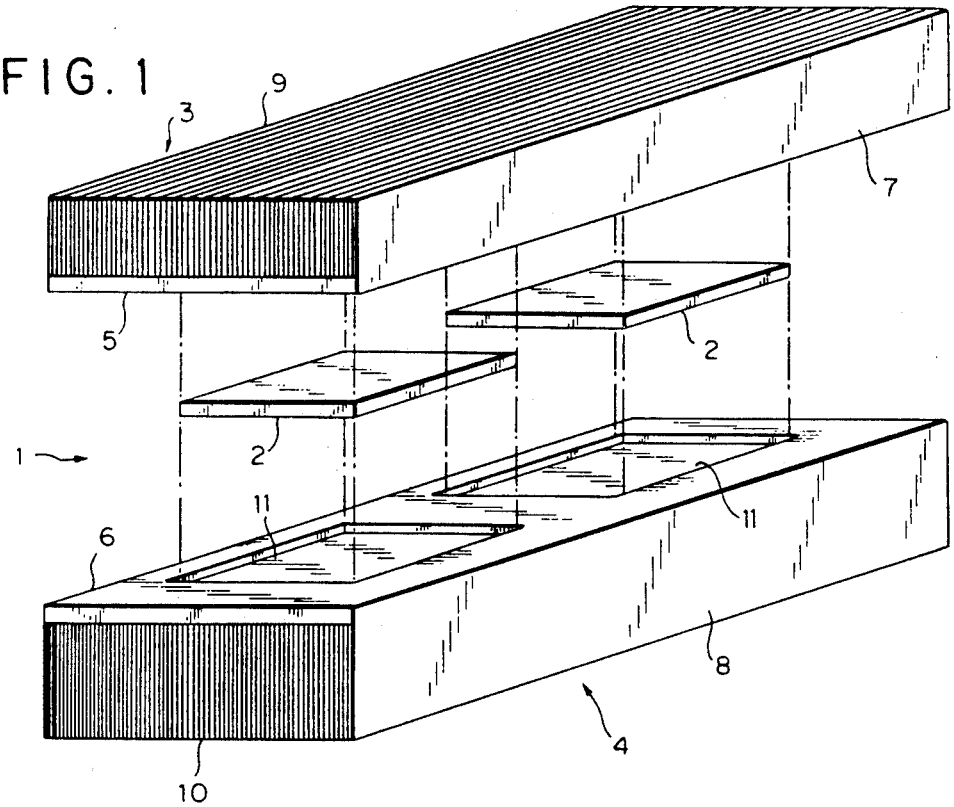
FIG. 1 is an enlarged perspective view of the Peltier effect heat-exchange unit according to the present invention.

With reference to FIG. 1, in which is shown the heat-exchange unit, generally indicated with 1, of the apparatus according to the present invention, with 2 are shown two Peltier effect plates, which in the following will be indicated merely as plates, preferably made of thermoelectric material formed by a quaternary alloy Bi-Te-Se-Sb, with suitable doping, treated so as to obtain a polycrystalline oriented state, produced by MELCOR-Trenton, N.J., U.S.A.

Although not shown, the plates 2 are conventionally connected to a source of low-voltage D.C. power supply, as a function of the polarity of which, as is known, is obtained a transfer of heat from one surface to the opposite surface of the plates 2 themselves.

In the present embodiment, it is assumed that said polarity of the electric power supply be such that the upper surface of plate 2 forms the cold surface, while the lower one forms the hot surface.

With reference numers 3 and 4 are generically indicated a first and a second heat exchanger respectively for the cold and hot surfaces of the plates 2.

More particularly, the heat exchangers 3 and 4 are formed by respective opposed base walls 5 and 6 of rectangular shape, each one integral with respective perpendicular edges 7 and 8 on the long sides, between which are placed a plurality of fins 9 and 10 fastened at their lower ends to the internal surface of the respective base walls 4 and 5 in a closely spaced relationship and parallel to each other and to the respective edges 7 and 8.

The material forming the heat-exchangers 3 and 4 is, obviously, a thermally conductive material and preferably aluminium.

In the external surfaces of the base walls 5, 6 of each heat-exchanger 3, 4 are formed housings for the plates 2, said housings being shown only in relation to the heat-exchanger 4, and being indicated with 11, having a depth equal to half the thickness of the plates 2, in such a way that on assembly the plates 2 are enclosed between the heat-exchangers 3 and 4 with their cold surfaces in contact with the former and their hot surfaces in contact with the latter.

In order to avoid a transfer of heat between the two exchangers 3 and 4 in their assembled condition, provision is made for a seal of thermoinsulating material to be interposed between their opposing surfaces, said seal obviously being excluded from the areas housing the plates 2.

It must here be underlined that in an alternative embodiment in the place of the fins 9 and 10 in the heat exchangers 3, 4 it is possible to provide respective zigzag, closed circuit, microtube systems, containing a liquid having high heat absorbing properties, for example Freon.

Figure 2:
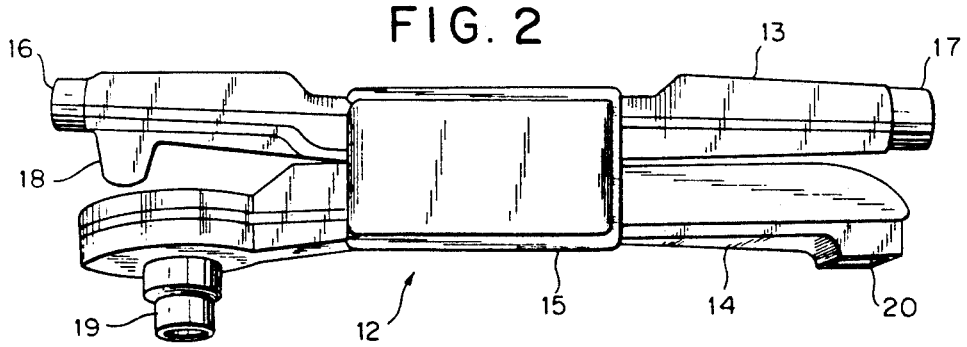
FIGS. 2 and 3 are side elevation and perspective views, respectively, of the apparatus in reference in its assembled condition
Figure 3:
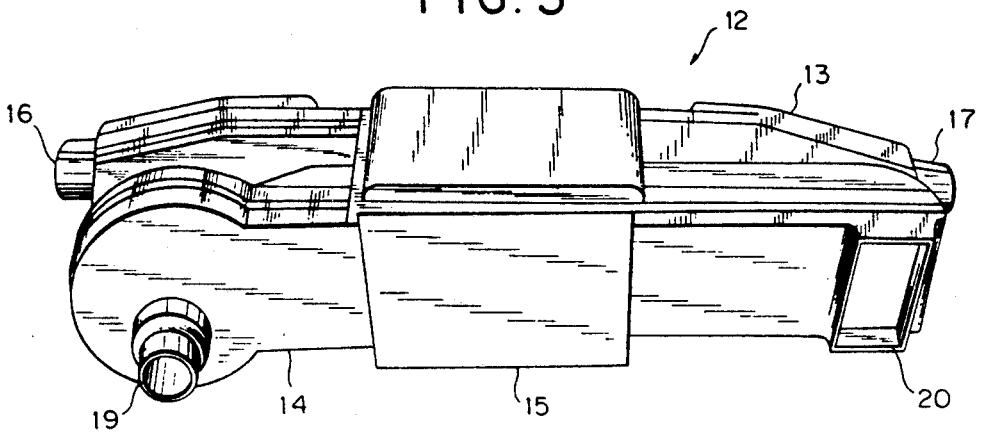

In FIGS. 2 and 3 is shown an example of embodiment of the apparatus according to the present invention comprising a housing, generally indicated with 12, in which are formed a first and a second channel 13 and 14 with a central chamber 15 common to both and housing the heat exchanger unit 1 described above with the exchangers 3 and 4 placed respectively in the first and second channel 13 and 14.

On the ends of the first channel 13 are provided a entrance connection 16 and respectively an exit connection 17 for the flow of air to be conditioned, said air being sucked up and made to circulate in a forced manner by a first motor/pump (not illustrated) having a high efficiency with explosion-proof characteristics, installed in a suitable housing 18 in correspondance with the entrance end of the channel 13.

In the second channel 14 is provided a closed end, corresponding to the entrance end of the first channel 13, said end being provided with an air inlet 19 of a second motor/pump (not illustrated) similar to that installed in the first channel 13, housed in said channel, whereas in the other end is formed a mouth 20 expell the air into the external surroundings.

To supply electric power to the Peltier effect plates 2 in the heat exchanger unit 1 placed, as described above, in the central chamber 15 of the housing 12, it is possible to provide appropriate batteries housed in the housing 12 itself, or else to provide a connection to an external battery system, or else to provide a connection to any external source c f electric power whatever by interposing suitable transformers.

In use, the air sucked through the entrance connection 16 of the first channel 13 of the housing 12 by means of said first motor/pump is made to flow by the latter in a forced manner through the fins 9 of the first heat exchanger 3 in contact with the cold surfaces of the Peltier effect plates 2, thus undergoing a reduction of temperature before being expelled through the exit connection 17 for use. At the same time the air sucked through the inlet 19 of said second motor/pump into the second channel 14 is made to flow in a forced manner through the fins 10 of the second heat exchanger 4 in contact with the hot surfaces of the plates 2, thus absorbing heat and therefore providing for the cooling of said hot surfaces, so as to avoid their overheating, before flowing out through the mouth 20 into the external environment.

It is understood that by inverting the polarity of the power source, due to the above mentioned characteristics of the Peltier effect plates, a consequent inversion of the heat transfer will be obtained, so that in the apparatus according to the invention described in precedence the air crossing the first heat exchanger 3 in the first channel 13 will undergo a heating instead of a cooling.

Figure 4:
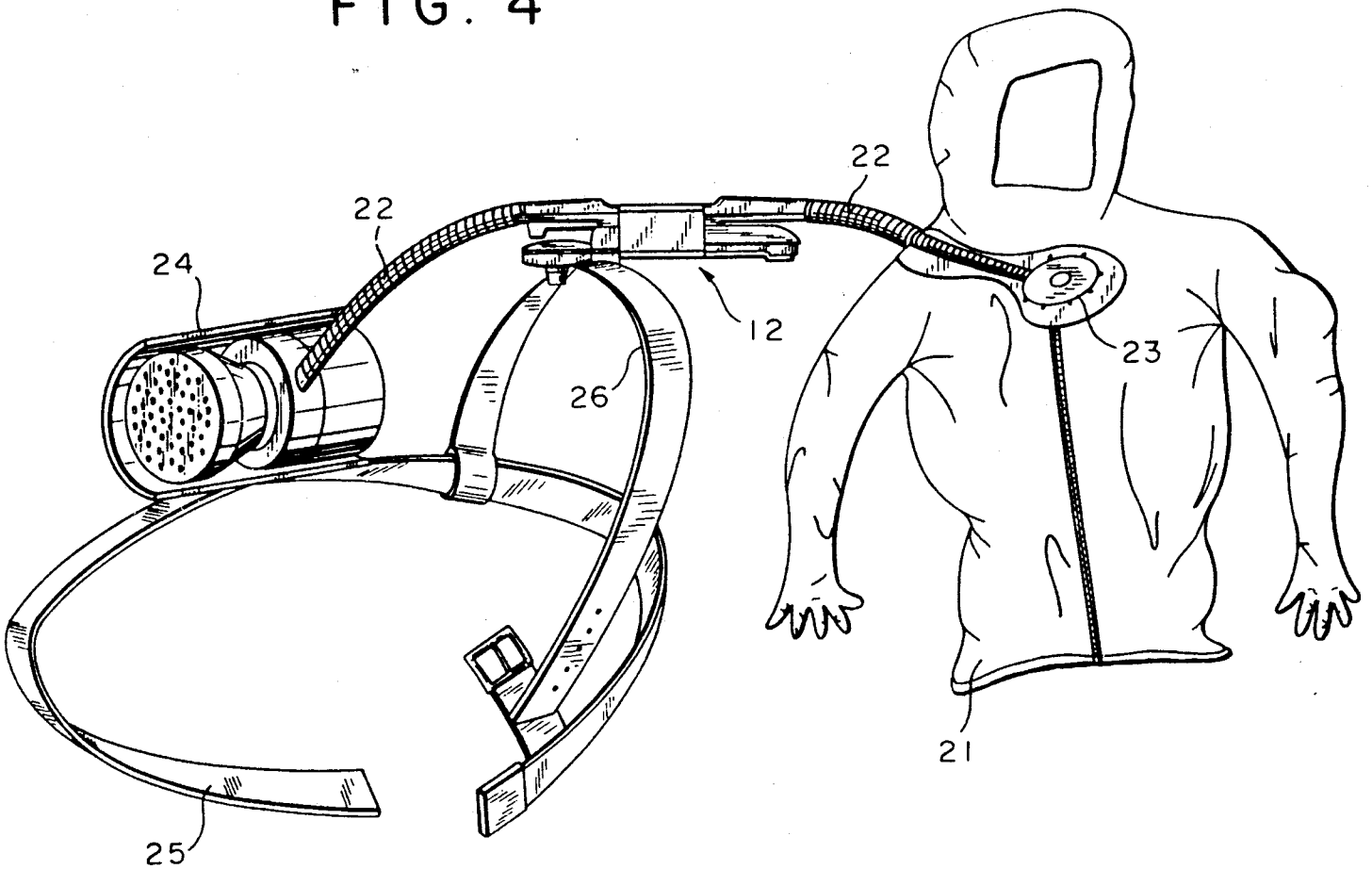
FIG. 4 is a global view of an embodiment of the apparatus in reference.

With reference to FIG. 4, a particular application of the apparatus according to the invention will be described for the air-conditioning of the air feeding a protective, total isolation suit for operations in environments with a toxic atmosphere.

At the present time protective systems are known using individual ventilated suits, the fundamental characteristic of which is an external connection with an air-flow generator (connection of an umbilical cord type).

The flow of air provided, as it has to permit, along with the internal ventilation, the breathing of the user, must take account of a series of limitations in terms of pressure, temperature and filtering, which are difficult to remote control without complex and bulky technical equipment. Furthermore the physical connection to the operator is guaranteed by a tube which can, in many cases, be a great handicap to the freedom of movement of the operator himself.

It is therefore important to have available a system which, although only within the limits of the volume of air surrounding the operator, allows control of the physical parameters which allow, in as far as it is possible, the best possible performance of the biological functions. In fact, to make it possible to obtain the physical parameters within which the operator can operate in a state of thermal well-being, it is necessary to consider the inside of the suit, and above all the space between the skin and the internal surface of the protective means, to be a sort of tiny microclimatic structure. In the devices (suits) presently known the problem of physiological comfort, which is fundamental for efficiency and autonomy of the user, has not been completely resolved.

It must be remembered that in certain dangerous surroundings where the external temperature is considerable, the minimum flow-rate required for breathing is not sufficient to remove biological heat and, on the other hand, the increase of said flow-rate creates physical discomforts such as drying of the mucous membranes, irritation of the breathing apparatus, etc.

This phenomenon actually forces the operator, in said circumstances, to take frequent rests, with the movement into a safe area, partial or total undressing, a pause for refreshment, dressing again, and resumption of work, all operations which reduce the work efficiency in terms of time by up to more than 50%, apart from the physiological overload which can often require preventive and periodical examinations of personal fitness.

To solve the abovementioned problems an opportune conditioning of the forced air is necessary, permiting operation at an adequate breathing temperature even when the external temperature reaches very high levels.

Said air conditioning could be obtained through the umbelical cord mentioned above connecting the suit (or the like) to a fixed generator of cooled air situated at a distance, but effective operating needs show that, in the majority of cases, said connection is problematical or impossible.

It is therefore necessary, in order to reach the desired object, that the conditioner be applied to the suit and therefore carried by the person, and that the electric power necessary be obtained preferably by means of a series of cells or portable batteries, without however excluding the possibility of an external electric power supply.

Said air conditioner must, furthermore, correspond to certain characteristics essential for its use in association with a suit of the kind mentioned above, and that is to say it must in particular have a limited weight and a reduced size, for example not superior to approximately 3–5 kilogrammes and 2 liters, respectively, sufficient power and low energy consumption.

The most widespread cooling devices available to the state of the art are essentially of two types:

1) fluid state change (freon, ammonia and the like);

2) absorbtion.

Type 1), which can in practice only be obtained by the use of Freon, corresponds well to the characteristics of low energy consumption, showing a performance (pumped energy/dissipated energy) of about 3:1, and to the power and bulk specifications, but counterbalances this with a considerable weight (a minimum of 10-12 kilogrammes), which is absolutedly inacceptable.

Type 2) has, as is known, an extremely low performance (1:6), a considerable bulk due to tubing, and a very low power.

It is in consideration of the above that the use of the miniaturized apparatus according to the present invention has been reached for the air-conditioning of the air feeding the above mentioned integral suits or the like, with surprising results both in efficiency and functionality.

In FIG. 4, is indicated with 21 a protective, total insulation suit of a conventional type, partially illustrated, destined in particular to be used by operators who have to work in contaminated and/or toxic surroundings.

The ventilation within the suit 21 is ensured by means of a flexible tube 22, one end of which is in sealed communication with a manifold 23 fixed to the back part of the suit 21 itself, and suitable for the distribution of the air to the various internal areas of the suit by means of a system of flexible tubes (not illustrated).

The other end of the flexible tube 22 is connected to an appropriate filter device 24, of a known kind, suitable for use in surroundings saturated with toxic substances, fixed to a belt 25, provided with shoulder strap 26, to be fixed to the waist of the operator.

According to the present invention, between the manifold 23 and the filter 24 is interposed the miniaturized air-conditioning apparatus described hereinbefore, the free end of the section of flexible tube 22 coming from the filter 24 being sealingly connected to the entrance connection 16 of the first channel 13 of the housing 12, that is to say that in which the heat exchanger 3 is placed in contact with the cold surfaces of the Peltier plates 2, whereas the exit connection 17 of said channel is sealingly connected to the free extremity of the section of flexible tube 22 which leads to the manifold 23, thus sending into the suit 21 filtered and air-conditioned air.

For the power supply of the Peltier plates 2 can be provided batteries contained within the housing 12 of the apparatus in question or, preferably, carried on the belt at the operator's waist, although it cannot be excluded, in a less preferable manner due to the consequent encumbrance, the use of a remote power supply through a suitable electric cable.

The use of the apparatus according to the present invention in protective systems of the kind mentioned in the example of application above described, or the like, undoubted and notable advantages are obtained, which can be briefly stated as independence of use, freedom of movement, thermal and respiratory well-being, great reduction of fatigue thanks to the miniaturized air-conditioning system, and possibility of application to any kind of suit or protective wrapping, along with the notable safety aspect for operation in surroundings in which the presence not only of toxic, but also of inflammable substances may exist.

The present invention is not limited to the embodiments described, but comprises any variation of the same.

We claim:

1. A miniaturized apparatus for air-conditioning comprising:

a heat-exchanger unit formed of a thermoelectric Peltier effect device, in which the application of a voltage difference creates a cold surface and hot surface opposite each other, and a first and a second contact heat-exchanger for thermic exchange respectively with said cold and said hot surfaces of said thermoelectric device; a low voltage D.C. power source feeding said thermoelectric device;

a system of channels suitable to allow respective distinct and separate flows of air through said first and said second heat-exchanger, said apparatus being interposed between the ends of a flexible tube feeding air to a protective total insulation suit, said flexible tube having one end sealingly connected to an air filter device and the other end sealingly connected to manifold sealingly fixed on said suit, capable of distributing filtered and conditioned air to the various internal areas of said suit by means of a system of flexible tubes.

2. Apparatus according to claim 1, in which said Peltier effect thermoelectric device is formed of at least one plate made of a bi- or plurimetallic alloy.

3. Apparatus according to claim 2, in which said Peltier effect device is formed by two or more of said plates, distinct and separate or series connected.

4. Apparatus according to claim 2, in which said Peltier plate or plates are made of a quaternary alloy of Bi-Te-Se-Sb.

5. Apparatus according to claim 1, in which each of said first and second heat-exchangers has a basic surface of quadrilateral shape, integral with two opposite, lateral, perpendicular edges, between which are situated a multiplicity of fins in a tightly spaced and parallel relationship to themselves and to said edges, said fins being fixed to an internal base surface.

6. Apparatus according to claim 1, in which said power source is formed by electric batteries housed inside said housing.

7. Apparatus according to claim 1, in which said motor/pump means are of an explosion-proof kind.

8. Apparatus according to claim 1, in which each of said first and second heat-exchangers comprises a multiplicity of tightly spaced and parallel fins.

9. Apparatus according to claim 1, in which said power source comprises electric batteries housed in said apparatus.

* * * * *